US010859081B2

(12) United States Patent
Nagahama et al.

(10) Patent No.: US 10,859,081 B2
(45) Date of Patent: Dec. 8, 2020

(54) TUBE PUMP

(71) Applicant: SUMITOMO RUBBER INDUSTRIES, LTD., Hyogo (JP)

(72) Inventors: Masamune Nagahama, Hyogo (JP); Hiroyuki Kaneko, Hyogo (JP); Hiroyuki Sugiura, Aichi (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 94 days.

(21) Appl. No.: 16/149,141

(22) Filed: Oct. 2, 2018

(65) Prior Publication Data

US 2019/0145398 A1 May 16, 2019

(30) Foreign Application Priority Data

Nov. 13, 2017 (JP) ..... 2017-218009
Apr. 3, 2018 (JP) ..... 2018-071712

(51) Int. Cl.
*F04B 43/12* (2006.01)
*F04B 53/16* (2006.01)

(52) U.S. Cl.
CPC ..... *F04B 43/1284* (2013.01); *F04B 43/1238* (2013.01); *F04B 43/1253* (2013.01); *F04B 43/1269* (2013.01); *F04B 43/1276* (2013.01); *F04B 53/16* (2013.01)

(58) Field of Classification Search
CPC ..... F04B 43/1253; F04B 43/1284; F04B 43/1269; F04B 53/16; F04B 43/1276
See application file for complete search history.

(56) References Cited

U.S. PATENT DOCUMENTS 2,693,765 A * 11/1954 Petri ..... F04B 43/1269 417/476
4,730,993 A 3/1988 Iwata
5,062,775 A 11/1991 Orth
6,296,460 B1 10/2001 Smith
2014/0271273 A1 9/2014 Carpenter
2019/0145399 A1* 5/2019 Hayashi ..... F04B 45/08 417/477.1

FOREIGN PATENT DOCUMENTS

FR 2473129 A2 * 7/1981 ..... F04B 43/0072
JP S5818584 2/1983
JP 2016520756 7/2016

OTHER PUBLICATIONS

Translation of FR2473129 (Year: 1981).*
"Search Report of Europe Counterpart Application," dated Mar. 19, 2019, p. 1-p. 7.

* cited by examiner

*Primary Examiner* — Patrick Hamo
*Assistant Examiner* — David N Brandt
(74) *Attorney, Agent, or Firm* — JCIPRNET

(57) ABSTRACT

A tube pump having small driving energy is provided. The tube pump includes: a flexible tube for conveying a fluid; a holder part holding the tube so that the tube is at least partially bent; a driving part; and at least one pressing part, rotationally driven around a first central axis by the driving part, and pressing the tube along the bent portion of the tube held by the holder part while rotating around the first central axis, thereby conveying the fluid in the tube. The pressing part has an inclined plane inclined from the side of the tube toward the side of the pressing part in a radially outward direction with reference to the first central axis.

13 Claims, 7 Drawing Sheets

TUBE PUMP

CROSS-REFERENCE TO RELATED APPLICATION

This application claims the priority benefit of Japan Application No. 2018-071712, filed on Apr. 3, 2018, which claims the priority benefit of Japan Application No. 2017-218009, filed on Nov. 13, 2017. The entirety of each of the above-mentioned patent applications is hereby incorporated by reference herein and made a part of this specification.

BACKGROUND

Technical Field

The disclosure relates to a pump assembly, particularly to a tube pump conveying a fluid through a tube.

Related Art

There is a pump for fluids, called a positive displacement pump, which presses a surface forming a passage of a fluid and deforms the passage to cause a change in volume of the passage, thereby conveying the fluid. As a pressing mechanism, a finger type, a roller type and the like are well-known. Roller type pressing mechanisms are disclosed in Japanese Laid-open (Translation of PCT Application) No. 2016-520756 and U.S. Pat. No. 6,296,460. In these pressing mechanisms, a plurality of rollers having the same shape are arranged around a central axis, and by driving these rollers to revolve around the central axis by a motor, pumping of the fluid is performed.

The rollers disclosed in Japanese Laid-open (Translation of PCT Application) No. 2016-520756 and U.S. Pat. No. 6,296,460 are in the shape of a truncated cone, and are installed so that an upper surface having a smaller diameter faces radially inward and a bottom surface having a greater diameter faces radially outward, with respect to the central axis. In such a configuration, since the center of gravity of the rollers are away from the central axis, the moment of inertia of the rollers increases, and driving energy for rotating the rollers increases.

SUMMARY

The disclosure provides a tube pump having small driving energy.

A tube pump according to a first aspect of the disclosure includes: a flexible tube for conveying a fluid; a holder part holding the tube so that the tube is at least partially bent; a driving part; and at least one pressing part, rotationally driven around a first central axis by the driving part, and pressing the tube along the bent portion of the tube held by the holder part while rotating around the first central axis, thereby conveying the fluid in the tube. The pressing part has, on a surface thereof facing the tube, an inclined plane inclined from the side of the tube toward the side of the pressing part in a radially outward direction with reference to the first central axis.

A tube pump according to a second aspect of the disclosure is the tube pump according to the first aspect, wherein the pressing part is in the form of a roller rotatable on a second central axis intersecting the first central axis.

A tube pump according to a third aspect of the disclosure is the tube pump according to the second aspect, wherein the pressing part rotates on the second central axis following its rotation around the first central axis.

A tube pump according to a fourth aspect of the disclosure is the tube pump according to the second or third aspect, wherein the pressing part is roughly in the shape of a truncated cone, the truncated cone including a bottom surface roughly orthogonal to the second central axis, an upper surface roughly orthogonal to the second central axis, having a smaller area than the bottom surface and disposed more outside than the bottom surface in the radial direction with reference to the first central axis, and a peripheral surface extending between the bottom surface and the upper surface, wherein the inclined plane is included in a portion of the pressing part equivalent to the peripheral surface.

A tube pump according to a fifth aspect of the disclosure is the tube pump according to any one of the first to fourth aspects, wherein the holder part has a tube space accommodating the tube. The tube space is defined by a first wall surface facing the pressing part, and a second wall surface erected from the first wall surface and abutting against the bent portion of the tube from the radial outside with reference to the first central axis.

A tube pump according to a sixth aspect of the disclosure is the tube pump according to the fifth aspect, wherein, when a height of the second wall surface from a deepest part of the tube space in the direction of the first central axis is set to h, and a radius of a cross section of the tube is set to r, $h \geq r$.

A tube pump according to a seventh aspect of the disclosure is the tube pump according to the fifth or sixth aspect, wherein the first wall surface has an inclined part inclined from the side of the tube toward the side of the pressing part in the radially outward direction with reference to the first central axis.

A tube pump according to an eighth aspect of the disclosure is the tube pump according to the seventh aspect, wherein the first wall surface further has a horizontal part continuous with the inclined part, roughly orthogonal to the first central axis, and disposed more outside than the inclined part in the radial direction with reference to the first central axis, and the second wall surface is erected from the horizontal part.

A tube pump according to a ninth aspect of the disclosure is the tube pump according to any one of the fifth to eighth aspects, wherein the tube space is further defined by a third wall surface erected from the first wall surface, facing the second wall surface, and disposed more inside than the second wall surface in the radial direction with reference to the first central axis, wherein one of the third wall surface and the second wall surface includes a claw part protruding from a height position spaced a predetermined distance from the first wall surface toward the other of the third wall surface and the second wall surface to prevent the tube from falling off from the tube space.

A tube pump according to a tenth aspect of the disclosure is the tube pump according to any one of the first to ninth aspects, further including a main body case accommodating the driving part and the pressing part, wherein the holder part and the main body case are configured separable from each other.

A tube pump according to an eleventh aspect of the disclosure is the tube pump according to the tenth aspect, wherein one of the holder part and the main body case has an engaging part, the other of the holder part and the main body case has an engaged part engaged with the engaging part, and the holder part is configured to be positioned with respect to the main body case when the engaging part and the engaged part are engaged with each other.

A tube pump according to a twelfth aspect of the disclosure is the tube pump according to the tenth or eleventh aspect, wherein one of the holder part and the main body case has a magnet on a surface facing the other of the holder part and the main body case, and the other of the holder part and the main body case has a magnetic body or a magnet facing and magnetically attracted by the above magnet.

A tube pump according to a thirteenth aspect of the disclosure is the tube pump according to any one of the first to twelfth aspects, further including an urging member urging the pressing part toward the holder part.

A pump assembly according to a fourteenth aspect of the disclosure includes: a flexible passage member defining a passage of a fluid; a driving part; and at least one pressing part, rotationally driven around a first central axis by the driving part, and pressing the passage member while rotating around the first central axis, thereby conveying the fluid in the passage. The pressing part has an inclined plane inclined from the side of the passage member toward the side of the pressing part in the direction of the first central axis in a radially outward direction with reference to the first central axis.

According to the first to thirteen aspects of the disclosure, the flexible tube for conveying the fluid is held by the holder part so as to be at least partially bent. The bent portion of the tube is pressed by the pressing part, the pressing part being rotationally driven around the first central axis by the driving part.

The pressing part has, on the surface thereof facing the tube, the inclined plane inclined from the side of the tube toward the side of the pressing part in the radially outward direction with reference to the first central axis. Accordingly, due to the existence of the inclined plane, the weight of the pressing part on the radial outside with reference to the first central axis is reduced, and the center of gravity of the pressing part is prevented from leaving from the first central axis. Thus, a tube pump having small driving energy is provided.

In addition, according to the fourteenth aspect of the disclosure, the flexible passage member defining the passage of the fluid is pressed by the pressing part, the pressing part being rotationally driven around the first central axis by the driving part. The pressing part has, on a surface thereof facing the passage member, the inclined plane inclined from the side of the passage member toward the side of the pressing part in the radially outward direction with reference to the first central axis. Accordingly, due to the existence of the inclined plane, the weight of the pressing part on the radial outside with reference to the first central axis is reduced, and the center of gravity of the pressing part is prevented from leaving from the first central axis. Thus, a pump assembly having small driving energy is provided.

DESCRIPTION OF THE EMBODIMENTS

A tube pump according one embodiment of the disclosure is hereinafter explained with reference to the drawings.

<1. Configuration of Tube Pump>

Figure 1:
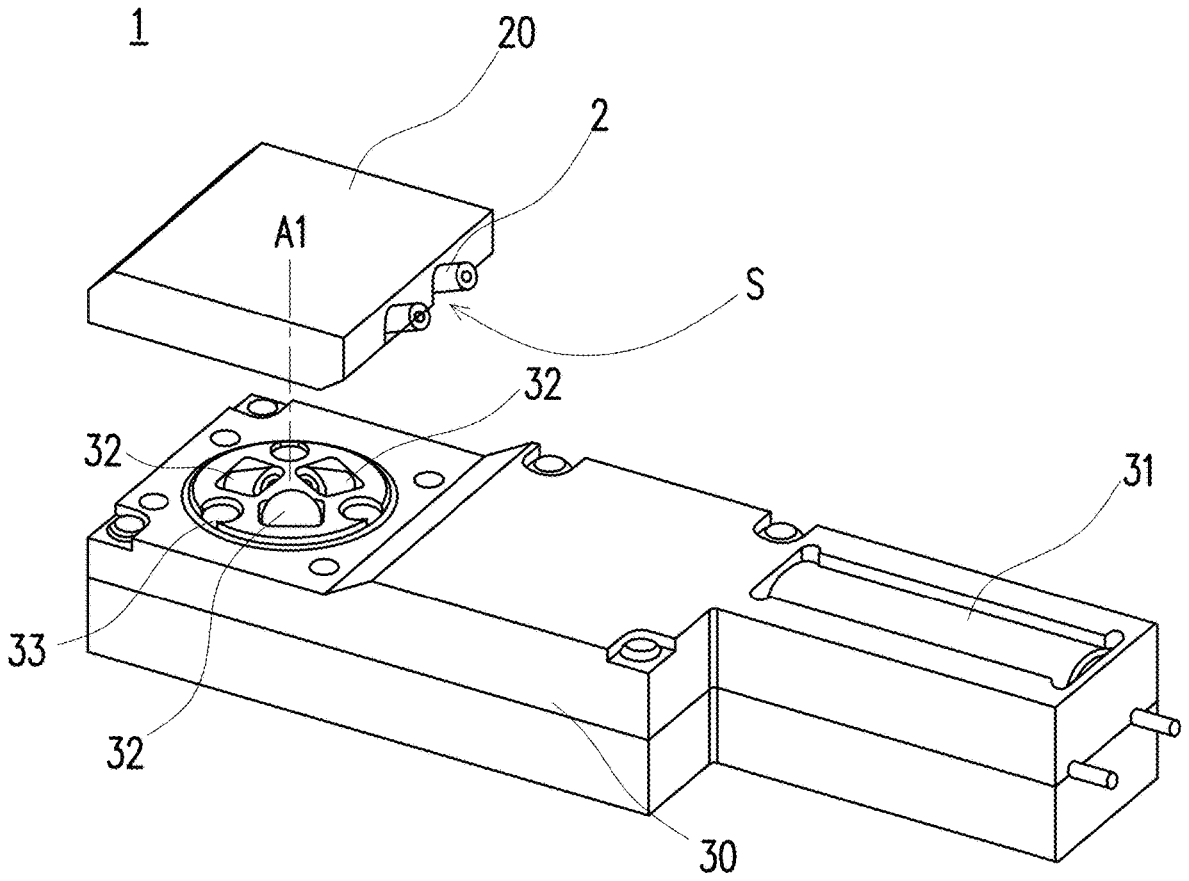
FIG. 1 is a schematic perspective view of a tube pump according to one embodiment of the disclosure.

FIG. 1 shows a schematic perspective view of a tube pump 1 (hereinafter sometimes simply "pump 1") according to the present embodiment. The pump 1 is an assembly for conveying a fluid, typically a liquid, and includes a flexible tube 2 forming a passage of the fluid, a holder part 20 holding the tube 2, and a main body case 30. The holder part 20 and the main body case 30 are installed so as to face each other with the tube 2 sandwiched therebetween. In the present embodiment, the holder part 20 is detachably separable from the main body case 30. An upstream end part and a downstream end of the tube 2 are respectively connected to an upstream component and a downstream component (both not illustrated). The upstream component and the downstream component can be properly selected according to uses of the pump 1. In addition, in the example of FIG. 1, both ends of the tube 2 protrude little from the holder part 20. However, the length of the tube 2 may also be properly selected according to uses of the pump 1.

The main body case 30 accommodates a driving part 31, and a pressing part 32 pressing the tube 2. In the present embodiment, the driving part 31 is a motor (to which the reference numeral 31 is also attached hereinafter), and the pressing part 32 is a roller (to which the reference numeral 32 is also attached hereinafter). The roller 32 is supported from a lower side by a rotating body 33 that is also accommodated in the main body case 30. Moreover, unless specified otherwise, the terms "upper" and "lower" mentioned in the present embodiment are defined using the state in FIG. 3B as a reference, namely, the side of the holder part 20 is the upper side, and the side of the main body case 30 is the lower side. The rotating body 33 is a roughly disk-shaped member having a central axis A1 (see FIG. 3B) extending vertically, and supports the roller 32 in such a manner that the roller 32 partially protrudes from an upper surface of the rotating body 33. In addition, the rotating body 33 and the roller 32 are accommodated in a state in which they are partially exposed on an upper surface of the main body case 30.

The motor 31 rotationally drives the rotating body 33 around the central axis A1. More specifically, an output shaft of the motor 31 is connected to a rotation transmission mechanism including gears 36*a* and 36*b* and so on, and a rotary shaft 34 of the most downstream gear 36*a* is fixed to the rotating body 33 (see FIG. 3B). The rotary shaft 34 is disposed so as to extend vertically and concentrically with the central axis A1. A cross section of the rotary shaft 34 has a non-circular shape, and is inserted into an opening formed on the rotating body 33 and the gear 36*a* that has substantially the same shape as the cross section of the rotary shaft 34. Hence, the rotating body 33 is connected to the gear 36*a* so as to be unable to rotate relative to the gear 36*a*.

Figure 3A:
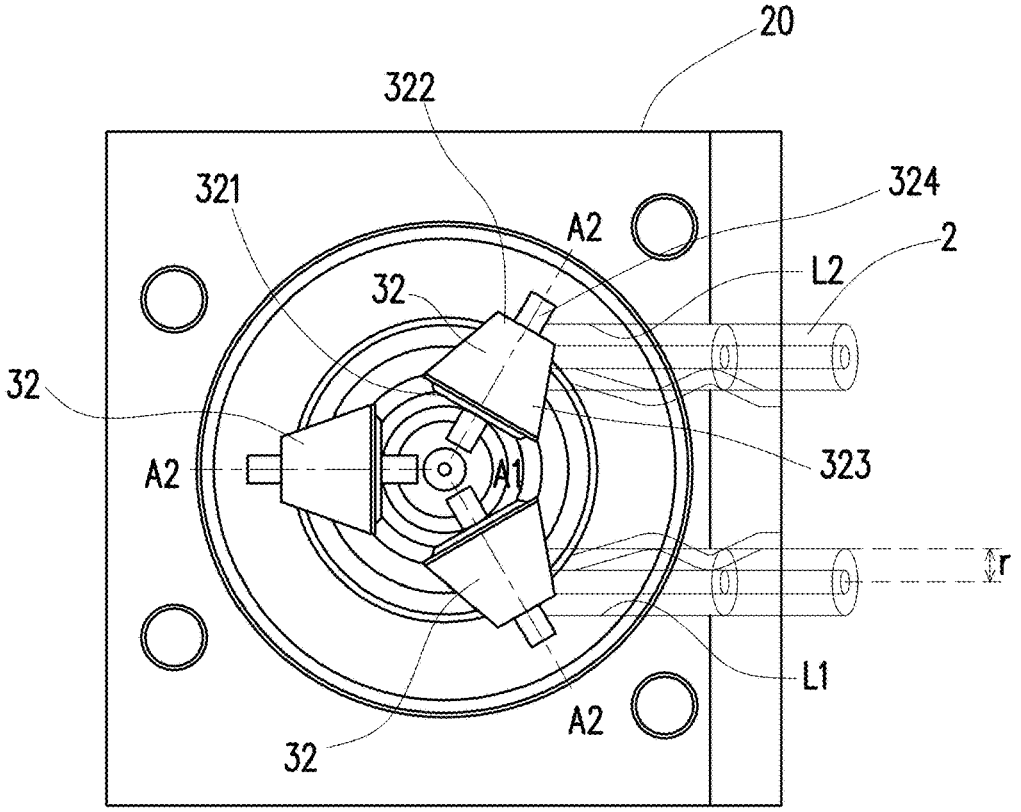
FIG. 3A is a bottom view showing a pressing part (roller) and the holder part of the tube pump according to one embodiment of the disclosure.
Figure 3B:
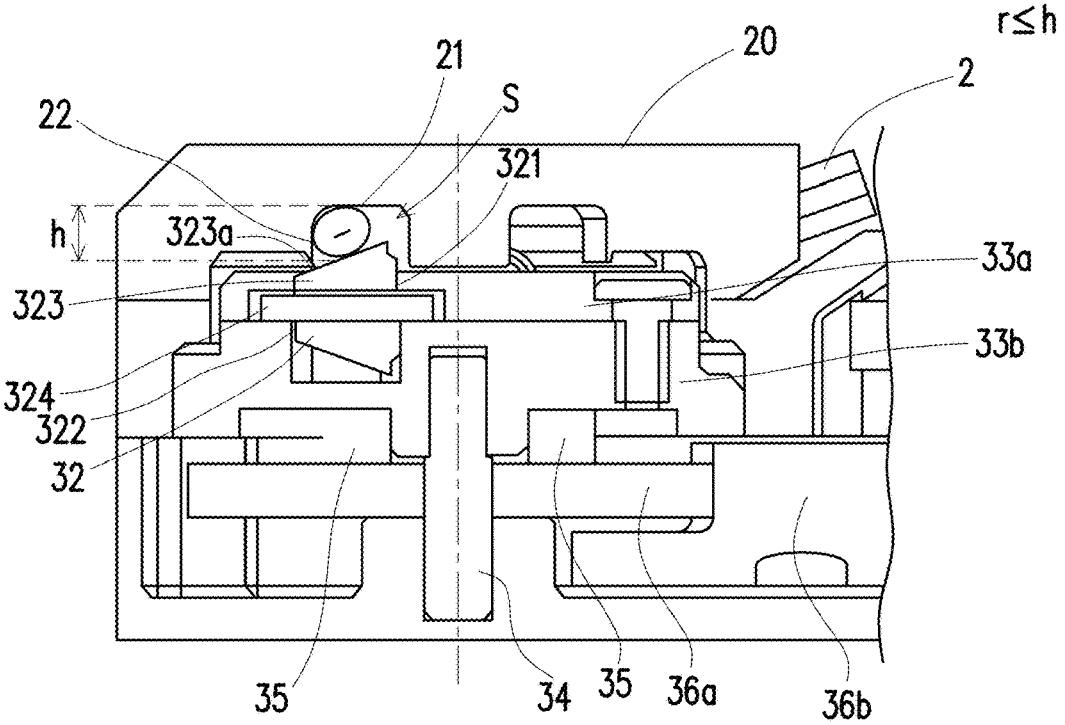
FIG. 3B is a lateral cross-sectional view showing a structure in the vicinity of the pressing part and the holder part of the tube pump according to one embodiment of the disclosure.

FIG. 3A is a bottom view of the roller 32 and the holder part 20 as viewed from the side of the roller 32; FIG. 3B is a lateral cross-sectional view of a portion in the vicinity of the roller 32 and the holder part 20. A plurality of rollers 32 are supported on the rotating body 33, wherein the rollers 32 are arranged around the central axis A1. The number of the rollers 32 is three in the present embodiment. However, the number is not particularly limited and may be one. In the present embodiment, the rollers 32 are arranged at equal intervals in a circumferential direction in positions spaced substantially the same distance from the central axis A1 in a radial direction. Moreover, in the explanation of the present embodiment, when only "radial direction" and "circumferential direction" are mentioned, the central axis A1 is taken as the reference. According to the above, the roller 32 together with the rotating body 33 are rotationally driven around the central axis A1 by the motor 31; at this moment, they revolve around the central axis A1. That is, the motor 31 causes the roller 32 to revolve around the central axis A1 through the rotation transmission mechanism including the gears 36*a* and 36*b* and so on, the rotary shaft 34 and the rotating body 33.

Figure 2:
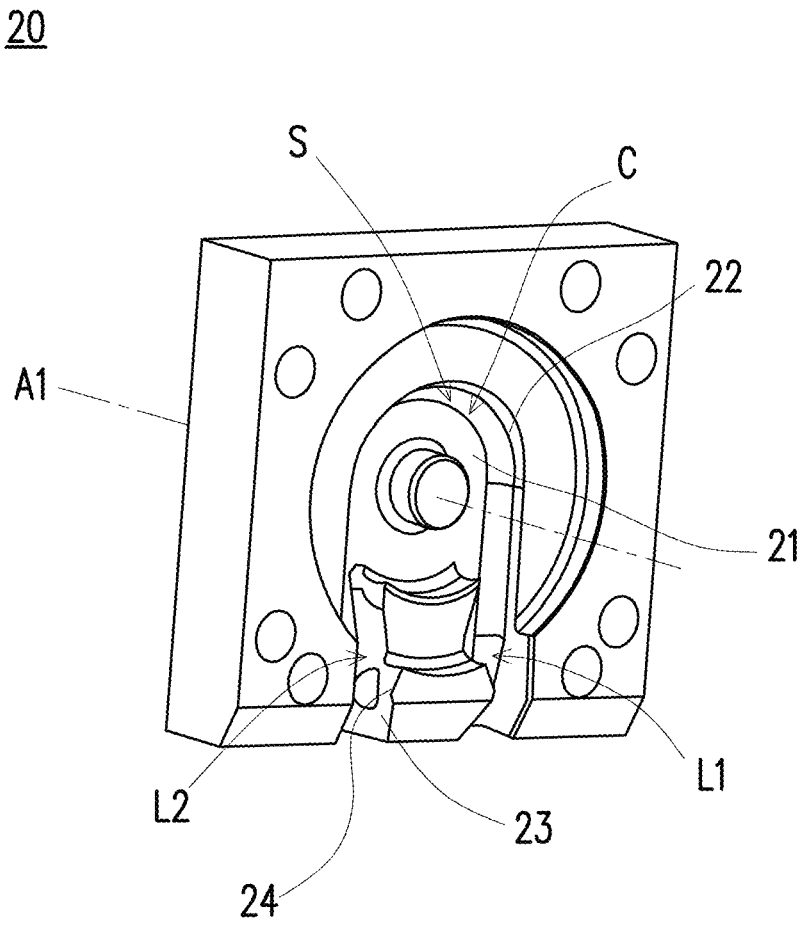
FIG. 2 is a schematic perspective view of a holder part of the tube pump according to one embodiment of the disclosure.

FIG. 2 shows a detailed configuration of the holder part 20. The holder part 20 is a plate-like member having roughly rectangular upper and lower surfaces, wherein a tube space S where the tube 2 is mounted is formed in the lower surface. Moreover, FIG. 2 shows a state of the holder part 20 as viewed from the side of the lower surface. The tube 2 is accommodated in the tube space S so as to be partially bent. More specifically, the tube space S of the present embodiment is U-shaped, having an arc portion C centered at the central axis A1, and linear portions L1 and L2, continuous with both ends of the arc portion C and continuing to an end face of the holder part 20. That is, in the state in which the tube 2 is mounted in the tube space S, the tube 2 is configured to be bent so as to describe an arc around the central axis A1, so that both ends of the tube 2 go outside the holder part 20. The tube space S has a groove-like shape and is defined by a first wall surface 21 equivalent to a bottom surface of the groove, as well as a second wall surface 22 and a third wall surface 23 erected from the first wall surface 21 and respectively equivalent to both sidewalls of the groove. The first wall surface 21 extends within a plane roughly orthogonal to the central axis A1, and the above roller 32 is positioned so as to face the first wall surface 21. The third wall surface 23 faces the second wall surface 22 and is disposed more inside than the second wall surface 22 in the radial direction with reference to the central axis A1.

In the present embodiment, all the rollers 32 have the same shape and each of them has a substantially truncated conical shape. More specifically, each roller 32 is of a shape having a bottom surface 321 and an upper surface 322, as well as a peripheral surface 323 extending between the bottom surface 321 and the upper surface 322. Moreover, among the bottom surface 321 and the upper surface 322 of the roller 32 that are orthogonal to the central axis A2, the one having a greater area is the bottom surface 321, and the one having a smaller area is the upper surface 322. In addition, in the present embodiment, the central axis A2 roughly orthogonal to the bottom surface 321 and the upper surface 322 of each roller 32 passes through a substantial center of both the bottom surface 321 and the upper surface 322. That is, each roller 32 has a substantially right truncated conical shape.

Each roller 32 is disposed so that the bottom surface 321 faces radially inward and the upper surface 322 faces radially outward, with reference to the central axis A1. That is, each roller 32 is disposed so that the upper surface 322 is more outside than the bottom surface 321 in the radial direction. In addition, each roller 32 is disposed so that the central axis A2 thereof is orthogonal to or substantially orthogonal to the central axis A1. Moreover, all the central axes A2 of the rollers 32 are roughly disposed within the same plane orthogonal to the central axis A1.

According to the above configuration, in the peripheral surface 323 of each roller 32, on a surface of the roller 32 facing the tube 2, an inclined plane 323*a* is formed. The inclined plane 323*a* is a surface inclined from the side of the tube 2 toward the side of the roller 32 in the radially outward direction with reference to the central axis A1, i.e., inclined so as to be away from the first wall surface 21. Due to the existence of the inclined plane 323*a*, the weight of the roller 32 on the radial outside with reference to the central axis A1 is reduced, and the center of gravity of the roller 32 is prevented from leaving from the central axis A1. Accordingly, the moment of inertia of the roller 32 when the roller 32 is rotationally driven around the central axis A1 decreases, and driving energy is reduced.

The roller 32 has a roller shaft 324 extending along the central axis A2, and is also capable of rotating on the roller shaft 324 while revolving around the central axis A1 as described above. The roller shaft 324 protrudes from the bottom surface 321 and the upper surface 322, and the protruding portion is supported by the rotating body 33. However, the method of supporting the roller shaft 324 is not particularly limited. The rotating body 33 of the present embodiment is composed of a first part 33*a* and a second part 33*b*, wherein a space is formed in a portion where the first part 33*a* and the second part 33*b* face each other, and the space functions as a bearing accommodating the roller shaft 324. Since the roller shaft 324 is roughly orthogonal to the central axis A1, the roller 32 is capable of rotating on the central axis A2. Moreover, in the present embodiment, the roller shaft 324 is not rotationally driven by a driving part such as a motor or the like, and the roller 32 is rotated by a frictional force received when the peripheral surface 323 of the roller 32 touches the tube 2 during revolution around the central axis A1. That is, the roller 32 rotates on the central axis A2 following its revolution around the central axis A1.

As shown in FIG. 3B, the holder part 20 is positioned with respect to the main body case 30 so that the tube space S formed in the lower surface of the holder part 20 accommodates a portion of the roller 32. More specifically, while the upper surface 322 of the roller 32 does not enter the tube space S, a portion of the bottom surface 321 and a portion of the peripheral surface 323 are accommodated in the tube space S. Moreover, at this moment, the bottom surface 321 is disposed so as to be more outside than the third wall surface 23 in the radial direction and the upper surface 322 is disposed so as to be more outside than the second wall surface 22 in the radial direction. According to the above configuration, the above inclined plane 323*a* contained in the peripheral surface 323 of the roller 32 presses the tube 2 upward and radially outward within the tube space S. That is, the tube 2 is pressed against the first wall surface 21 and the second wall surface 22. As a result, the tube 2 is reliably accommodated in the tube space S and becomes unlikely to fall off from the tube space S.

In addition, in the present embodiment, a spring 35 is disposed below the second part 33*b* of the rotating body 33, urging the rotating body 33 toward the holder part 20 above. Urging force of the spring 35 becomes a force pushing the roller 32 supported by the rotating body 33 upward, and consequently becomes a force of the roller 32 pressing the tube 2 against the first wall surface 21. In the present embodiment, due to the spring 35, the tube 2 becomes more unlikely to fall off from the tube space S.

In addition, in the present embodiment, a radius of the arc portion C of the tube space S is smaller than a natural minimum bending radius of the tube 2. The natural minimum bending radius is a radius (outermost diameter) of the arc described by the tube 2, formed when an external force is applied in the following manner. Both ends of the tube 2 are held in a state in which no restraint is imposed on the tube 2, and one end is bent 180° relative to the other end so that the both ends become parallel to each other, and the external force is applied so that the entire tube 2 becomes U-shaped. Hence, when the tube 2 is mounted in the tube space S, the second wall surface 22 abuts against the bent portion of the tube 2 from the radial outside and the tube 2 is strongly pressed against the second wall surface 22. That is, when the tube 2 is bent along the arc portion C in order to be mounted in the tube space S, a great restoring force trying to extend the tube 2 toward the second wall surface 22 acts. The restoring force generates a great frictional force against the second wall surface 22 of the tube 2, and the tube 2 becomes unlikely to slide on the second wall surface 22, such that the tube 2 can be reliably fixed in the tube space S.

Moreover, even if the radius of the arc portion C of the tube space S is equal to or greater than the natural minimum bending radius of the tube 2, since a restoring force trying to restore the bent tube 2 to a linear shape acts, the tube 2 can be reliably fixed in the tube space S. However, by setting the radius of the arc portion C of the tube space S smaller than the natural minimum bending radius, various components including the holder part 20 and the roller 32 and so on can be reduced in size.

Figure 4A:
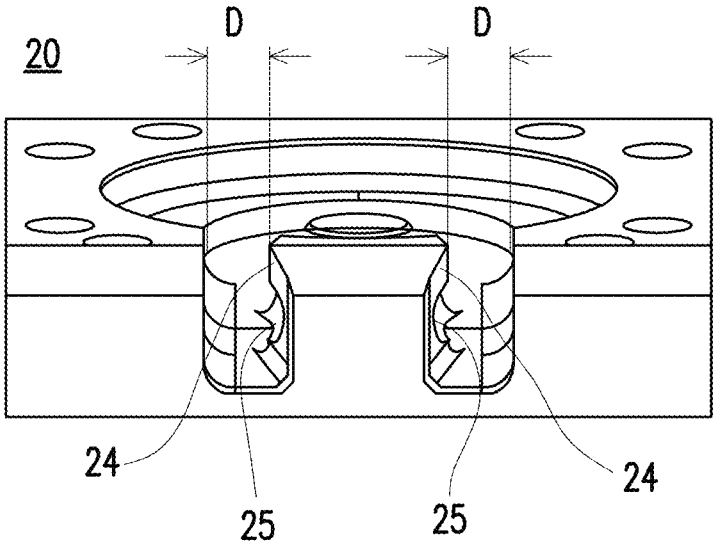
FIG. 4A is a schematic perspective view of the holder part of the tube pump according to one embodiment of the disclosure, as viewed from an end face of the holder part.
Figure 4B:
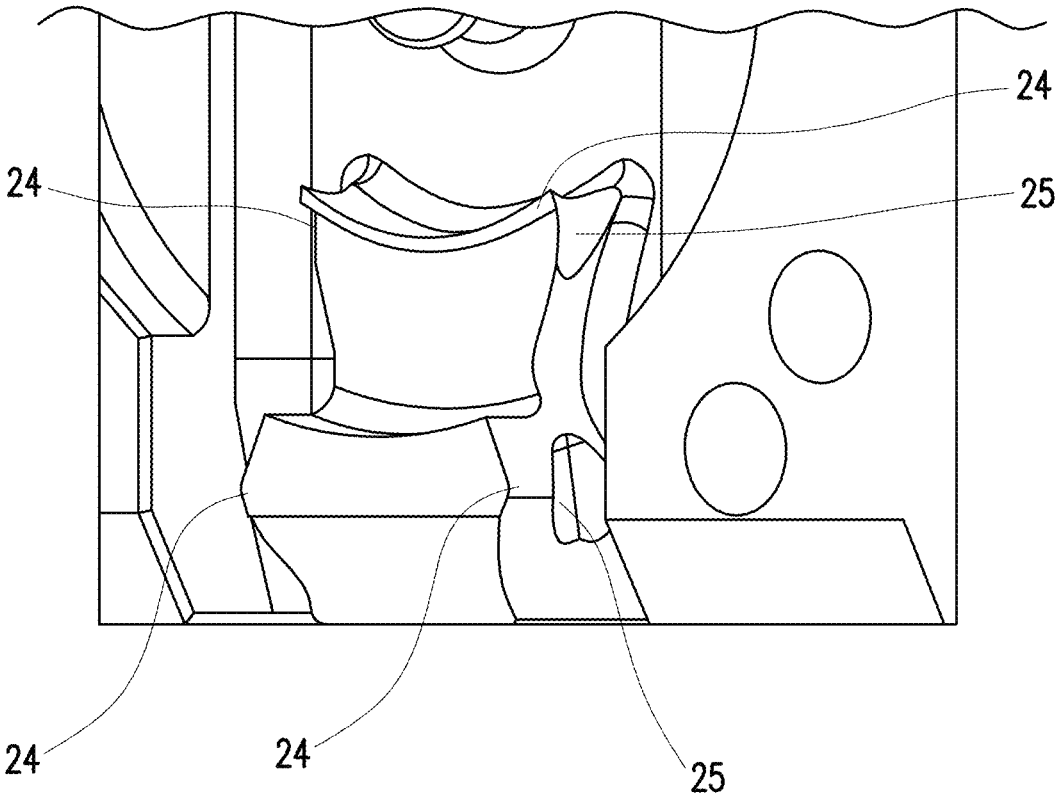
FIG. 4B is a schematic perspective view showing details in the vicinity of a claw part of the holder part of the tube pump according to one embodiment of the disclosure.

In addition, in the present embodiment, on the third wall surface 23 in the linear portions L1 and L2 of the tube space S, a claw part 24 protruding toward the second wall surface 22 is formed. The claw part 24 is disposed spaced a predetermined distance vertically from the first wall surface 21, and the distance between the claw part 24 and the first wall surface 21 is formed to such an extent that the tube 2 is sandwiched between the claw part 24 and the first wall surface 21. As shown in FIG. 4A, the most protruding portion of the claw part 24 does not reach the second wall surface 22, and a fixed distance D is maintained between the most protruding portion of the claw part 24 and the second wall surface 22. The distance D is a distance that allows the tube 2 compressed by elastic deformation to pass between the claw part 24 and the second wall surface 22. That is, while the tube 2 can pass between the claw part 24 and the second wall surface 22 and be mounted in the tube space S, once the tube 2 has been mounted in the tube space S, the tube 2, which has been restored to its original shape by its elasticity, is restrained by the claw part 24 and will not fall off from the tube space S. By this configuration, the tube 2 can be restrained within the tube space S without the need for a separate fixation device or the like. That is, while work efficiency in assembling the holder part 20 onto the main body case 30 is ensured, the tube 2 can be more reliably prevented from falling off from the holder part 20. Moreover, as shown in FIG. 4B, in the present embodiment, a notch part 25 is formed in the claw part 24 along an outer peripheral surface of the tube 2, and the tube 2 is accommodated in a space between the second wall surface 22 and the third wall surface 23 that is widen by the notch part 25. In addition, the number of the claw part 24 is not limited to one, but a plurality of claw parts 24 may be formed. In the present embodiment, four claw parts 24 are disposed in the vicinity of the end face of the holder part 20. In addition, the claw part 24 can be formed on the second wall surface 22 instead of the third wall surface 23, and can also be formed on both the second wall surface 22 and the third wall surface 23.

Herein, a height (which is consistent with the height of the second wall surface 22 with reference to the first wall surface 21 in the present embodiment) of the second wall surface 22 from a deepest part of the tube space S along the central axis A1 is set to h. At this moment, in the present embodiment, a relationship between the height h and a cross section radius r of the tube 2 is configured so as to satisfy $h \geq r$. Moreover, the "cross section radius of the tube 2" mentioned herein refers to a radius relative to an outer diameter of the tube 2 in a case where the tube 2 is cut off by a plane longitudinally orthogonal to the tube 2 in a state in which no external force is applied to the tube 2. By configuring the height h in this way, the tube 2 can be more reliably prevented from falling off from the holder part 20.

As mentioned above, in the present embodiment, various devices are applied in order to prevent the tube 2 from falling off from the holder part 20. According to the above devices, during pressing of the tube 2 by the roller 32, the tube 2 is stably held in a proper position. That is, it can be prevented that the position of the tube 2 deviates within the tube space S and flow rate accuracy is reduced.

<2. Operation of Tube Pump>

Hereinafter, operation of the pump 1 is explained with reference to the drawings. The pump 1 is used in a state in which the holder part 20 holding the tube 2 is mounted on the main body case 30 as shown in FIG. 3B. Moreover, although not shown in FIG. 1, both ends of the tube 2 are respectively connected to an upstream component and a downstream component. As shown in FIG. 3B, in the state in which the holder part 20 is mounted on the main body case 30, the tube 2 in the tube space S is surrounded by the first wall surface 21, the second wall surface 22 and the roller 32.

The motor 31 is connected to a power supply or a battery (both not illustrated) via a lead wire. When the pump 1 is switched on and electric power is supplied from the power supply or the battery to the motor 31, the motor 31 rotates to rotate the rotary shaft 34. At this moment, a rotation speed of the motor 31 is reduced by the rotation transmission mechanism including the gears 36*a* and 36*b* and so on, and is transmitted to the rotary shaft 34. Driving of the motor 31 can be intermittent or continuous.

The rotating body 33 rotates around the central axis A1 together with the rotary shaft 34. Then, with rotation of the rotating body 33, the roller 32 also rotates (revolves) around the central axis A1, and presses the tube 2 by the peripheral surface 323 so as to block the passage in the tube 2. At this moment, the fluid is stored in the tube 2 upstream of a position at which the roller 32 blocks the tube 2. When the roller 32 rotates further to move from the position toward downstream, the stored fluid moves from upstream to the position. When the roller 32 rotates again to rotate around the position, the fluid at the position is moved downstream by the roller 32, and the passage in the tube 2 is blocked again. By repeating the above operation, the pump 1 is capable of sending the fluid from the upstream component to the downstream component at a predetermined flow speed. That is, while revolving around the central axis A1, the roller 32 presses the tube 2 along the bent portion of the tube 2 so as to squeeze the tube 2 in a fixed direction, and the fluid is conveyed within the tube 2 by this operation of the roller 32. Moreover, since the roller 32 is supported rotatable on the roller shaft 324, the roller 32 also rotates on the central axis A2 by the frictional force formed between the tube 2 and the peripheral surface 323. In this way, since the roller 32 rotates on the central axis A2 following its revolution around the central axis A1, the pressing operation can be smoothly performed and a load on the motor 31 caused by frictional resistance can be reduced. Accordingly, the driving energy required for revolving the roller 32 is reduced.

The spring 35 urges the rotating body 33 including the roller 32 from the side of the second part 33*b* toward the holder part 20. By doing so, the tube 2 is reliably accommodated in the tube space S and the roller 32 can be maintained in a suitable position with respect to the tube 2.

As mentioned above, by the restoring force that acts by bending, the tube 2 is held in the tube space S in the state in which the tube 2 reliably abuts against the first wall surface 21 and the second wall surface 22 of the arc portion C of the tube space S. In addition, since the tube 2 is pressed by the inclined plane 323*a* of the roller 32 from the radial inside toward the side of the second wall surface 22, it can be prevented that the tube 2 moves toward the side of the third wall surface 23 to escape from the pressing from the roller 32. In addition, due to the existence of the inclined plane 323*a*, while interference between the second wall surface 22 and the peripheral surface 323 of the roller 32 and between the third wall surface 23 and the peripheral surface 323 of the roller 32 is avoided, the roller 32 can press the tube 2 until the tube 2 is blocked.

<3. Characteristics>

The cross section radius r of the tube 2 used in the present embodiment is about 1 (mm). In the case where a tube having a relatively small diameter like this is mounted in a predetermined position in an apparatus, operator's skill is usually required. However, by configuring the tube space S as in the present embodiment, it also becomes possible even for, for example, a general user not skilled in mounting tubes, to properly mount the tube 2 in the tube space S. In addition, once the tube 2 has been mounted in the tube space S, it is unlikely to fall off. Furthermore, since a tube having a special shape is not required, convenience can be improved and cost can be reduced. Moreover, the above cross section radius r of the tube 2 is only one example, and the cross section radius r of the tube 2 can be properly changed according to uses of the pump 1.

<4. Modifications>

The above has explained several embodiments of the disclosure. However, the disclosure is not limited to the above embodiments but can be modified in various ways without departing from the gist thereof. For example, the following modifications are possible. In addition, the gists of the following modifications can be properly combined.

<4-1>

The pressing part 32 is not limited to the form of a roller, and may be configured to be non-rotatable on its own axis. Moreover, when the pressing part 32 is non-rotatable on its own axis, the pressing part 32 always faces the tube 2 with the same surface. In that case, as long as the surface of the pressing part 32 facing the tube 2 is formed as an inclined plane inclined from the side of the tube 2 toward the side of the roller 32 in a direction away from the central axis A1, the other portions of the pressing part 32 can be set in an arbitrary shape.

<4-2>

The shape of the pressing part 32 is not limited to a substantially truncated conical shape, but may be, for example, a substantially conical shape. In addition, the shape may also be a substantially cylindrical shape or a substantially oblique cylindrical shape in which the upper surface has a diameter equal to that of the bottom surface. In this case, by properly inclining the central axis A2 with respect to the direction orthogonal to the central axis A1, on the surface of the pressing part 32 facing the tube 2, the inclined plane inclined from the side of the tube 2 toward the side of the roller 32 in the direction away from the central axis A1 can be formed.

<4-3>

In the above embodiments, the central axis A2 being a rotation axis of the roller 32 intersects the central axis A1 being a revolution axis so as to be orthogonal to the central axis A1. However, the rotation axis A2 may intersect the central axis A1 so as to form an angle with respect to a straight line orthogonal to the revolution axis A1.

<4-4>

Figure 5:
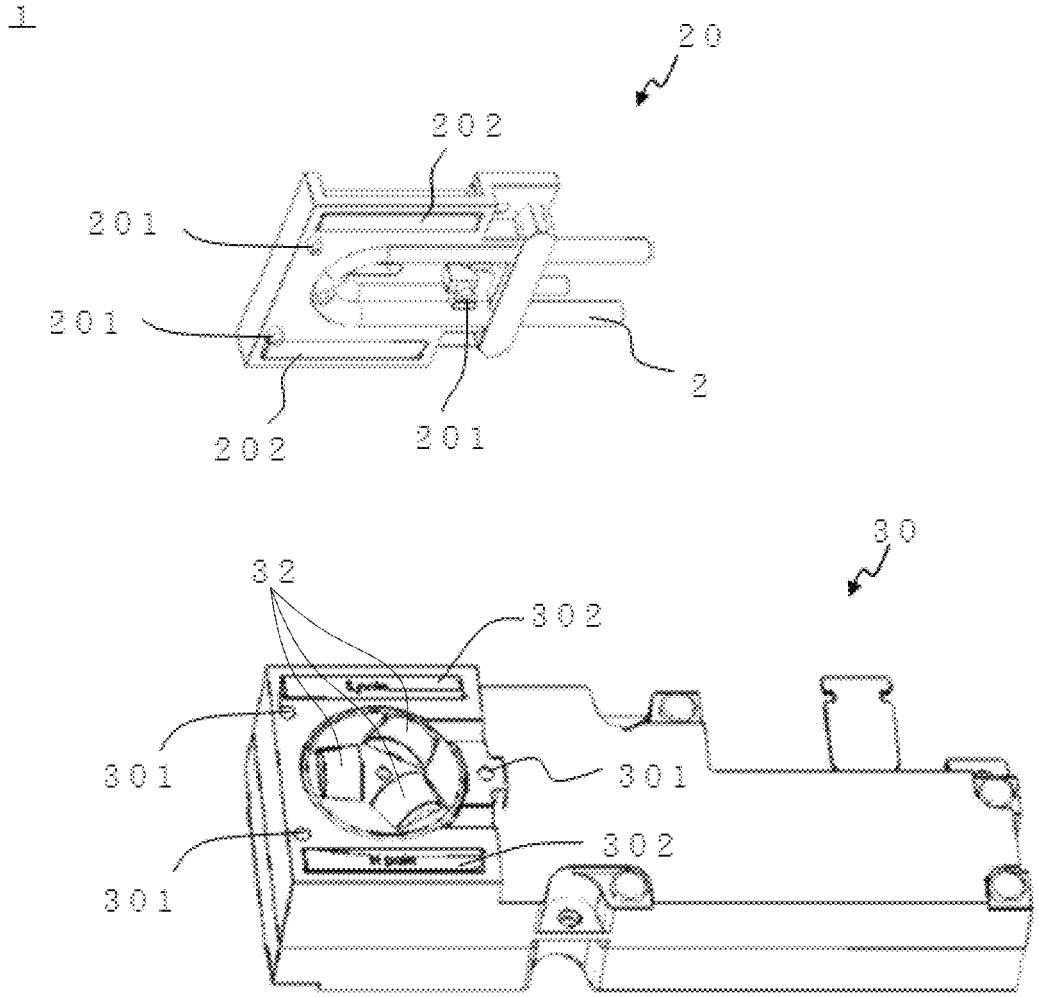
FIG. 5 is a perspective view showing a configuration of the tube pump according to a modification.

One of the holder part 20 and the main body case 30 has an engaging part, and the other of the holder part 20 and the main body case 30 has an engaged part engaged with the engaging part. The holder part 20 may be configured to be positioned with respect to the main body case 30 when the engaging part and the engaged part are engaged with each other. FIG. 5 is a perspective view of the holder part 20 and the main body case 30 configured in this manner. In the example of FIG. 5, as the engaging part, three convex parts 201 protruding toward the upper surface of the main body case 30 are formed on a surface of the holder part 20 facing the roller 32. Meanwhile, as the engaged part, concave parts 301 depressed toward the inside of the main body case 30 are formed on a surface of the main body case 30 facing the holder part 20. The three convex parts 201 and the three concave parts 301 are formed in positions in a one-to-one correspondence manner when the holder part 20 and the main body case 30 face each other. When the three sets of convex parts 201 and concave parts 301 are engaged with each other, the holder part 20 is positioned in a correct position with respect to the main body case 30. As a result, flow rate accuracy of the pump 1 is improved.

The convex part 201 as the engaging part may be provided on either the holder part 20 or the main body case 30. However, in the case where the holder part 20 is made a disposable component, and a unit including the main body case 30 and the various components such as the driving part 31 and the roller 32 that are accommodated in the main body case 30 is made a reuse component to be repeatedly used, the convex part 201 is desirably provided on the holder part 20. The reason is that, compared to the concave part 301, the convex part 201 is more easily damaged by bending or the like. In addition, the holder part 20 may have a convex part and a concave part; furthermore, the main body case 30 may have a concave part and a convex part corresponding to the above. Furthermore, the shape of the engaging part and the engaged part and the number of sets of the engaging part and the engaged part are not limited to those in this example and can be properly modified. However, from the viewpoint of improving accuracy of positioning of the holder part 20 and the main body case 30, the number of sets of the engaging part and the engaged part is preferably a plural number.

<4-5>

One of the holder part 20 and the main body case 30 may have a magnet on a surface facing the other of the holder part 20 and the main body case 30, and the other of the holder part 20 and the main body case 30 may have a magnetic body or a magnet facing and magnetically attracted by the above magnet. By this configuration, the holder part 20 is more easily positioned; in addition, operability of attachment and detachment of the holder part 20 to and from the main body case 30 is improved. In the example shown in FIG. 5, the main body case 30 has two magnets 302 and 302 on the surface facing the holder part 20. In this example, the magnets 302 are embedded in the main body case 30 so that only upper surfaces of the magnets 302 are respectively exposed from the upper surface of the main body case 30 and the upper surfaces of the magnets 302 are roughly flush with the upper surface of the main body case 30. Meanwhile, the holder part 20 has two magnetic bodies 202 and 202 that respectively face the magnets 302 and 302 when the holder part 20 is combined with the main body case 30. In this example, the magnetic bodies 202 are fixed to the holder part 20 so that a surface of the magnetic bodies 202 facing the magnets 302 is roughly flush with the surface of the holder part 20 facing the main body case 30. At least one of the magnetic bodies 202 and 202 can be changed to a magnet. The magnets 302 respectively magnetically attract the magnetic bodies 202 they face, and the position of the holder part 20 with respect to the main body case 30 is fixed. A strength of a force by which the magnets 302 attract the magnetic bodies 202 can be set to such an extent that, while a user holds the main body case 30 with one hand, they can separate the holder part 20 from the main body case 30 with the other hand. The number of sets of the magnet and the magnetic body is not limited to that in the example of FIG. 5, and can be properly set. Furthermore, it is also possible to form the engaging part and the engaged part of Modification 4-4 by magnets, or by a magnet and a magnetic body.

<4-6>

Figure 6A:
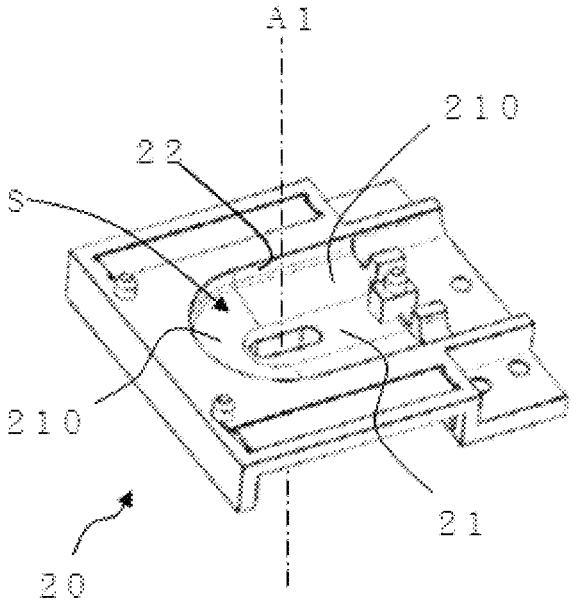
FIG. 6A is a schematic perspective view of the holder part of the tube pump according to a modification.
Figure 6B:
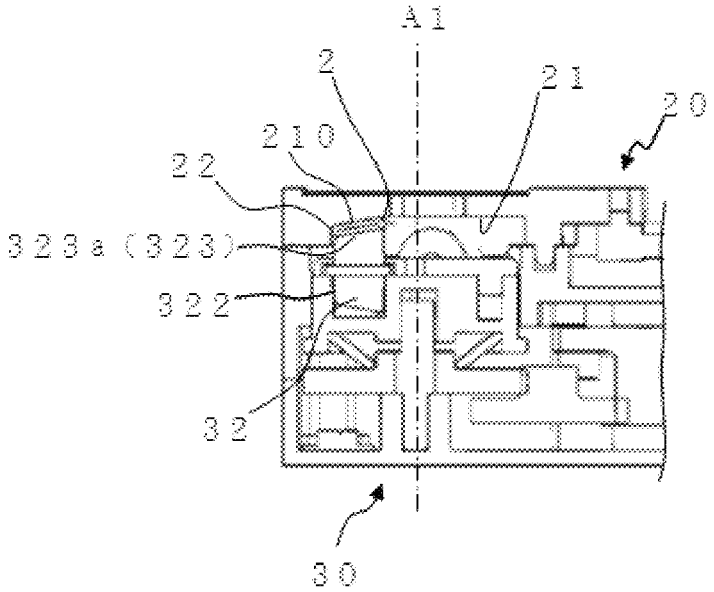
FIG. 6B is a lateral cross-sectional view showing a structure in the vicinity of the pressing part and the holder part of the tube pump according to a modification.

The first wall surface 21 of the holder part 20 defining the tube space S may have an inclined part 210 inclined from the side of the tube 2 toward the side of the roller 32 being the pressing part in the radially outward direction with reference to the central axis A1. FIG. 6A is a perspective view of the holder part 20 configured in this manner; FIG. 6B is a lateral cross-sectional view showing a structure in the vicinity of the holder part 20 having the inclined part 210 and the roller 32. An inclination angle of the inclined part 210 with respect to a plane orthogonal to the central axis A1 is not particularly limited. However, as shown in FIG. 6B, the inclination angle is desirably set so that, when the tube pump 1 operates, the inclined part 210 becomes parallel to or substantially parallel to the inclined plane 323*a* formed by the peripheral surface 323 of the roller 32. In addition, at this moment, the upper surface 322 of the roller 32 is desirably configured to be located more inside than the second wall surface 22 in the radial direction with reference to the central axis A1. By doing so, the tube 2 is surrounded by the inclined part 210, the second wall surface 22 and the peripheral surface 323 (the inclined plane 323*a*). Thus, pressing force of the roller 32 can be easily transmitted to the tube 2, and the tube 2 can be more reliably blocked. Furthermore, a dimension of the tube 2 when the tube 2 is blocked can be easily specified, dimensions of the roller 32 and the first wall surface 21 and so on can be determined based on the above dimension, and designing the pump 1 becomes easy.

<4-7>

Figure 7A:
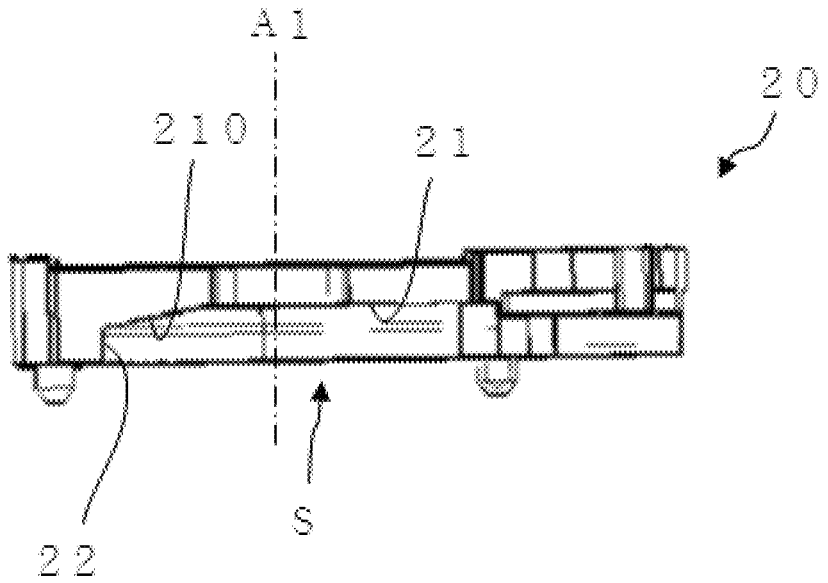
FIG. 7A is a lateral cross-sectional view of the holder part of the tube pump according to a modification.
Figure 7B:
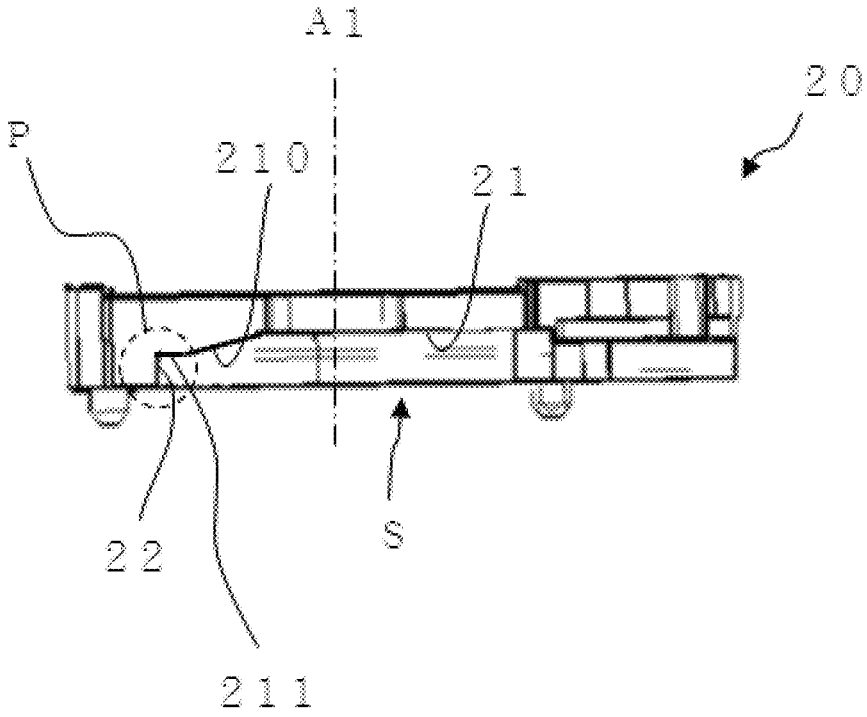
FIG. 7B is a lateral cross-sectional view of the holder part of the tube pump according to another modification.

The first wall surface 21 further has a horizontal part 211 continuous with a radially outer peripheral edge of the inclined part 210 and roughly orthogonal to the central axis A1, and the second wall surface 22 may be configured to be erected from a radially outer peripheral edge of the horizontal part 211. FIG. 7A is a lateral cross-sectional view of the holder part 20 having the inclined part 210 but not having the horizontal part 211; FIG. 7B is a lateral cross-sectional view of the holder part 20 having both the inclined part 210 and the horizontal part 211. When the horizontal part 211 is formed as in FIG. 7B, a pocket part P is formed by the horizontal part 211 and the second wall surface 22. The pocket part P functions as an adhesive reservoir in the case where the tube 2 is fixed in the tube space S using an adhesive.

For example, when the adhesive is applied on a radially outside surface of the bent portion (the portion along the arc portion C) of the tube 2 to fix the bent portion to the first wall surface 21 and the second wall surface 22, the adhesive applied on the tube 2 accumulates in the pocket part P and is unlikely to flow out from the inclined part 210 in the direction of the central axis A1 and downward. In this way, the tube 2 can be reliably attached to the tube space S. As a result, the tube 2 becomes more unlikely to fall off from the tube space S.

What is claimed is:

1. A tube pump, comprising:

a flexible tube for conveying a fluid;

a holder part holding the tube so that the tube is at least partially bent;

a motor; and at least one pressing part, rotationally driven around a first central axis by the motor, and pressing the tube along the bent portion of the tube held by the holder part while rotating around the first central axis, thereby conveying the fluid in the tube, wherein the pressing part has, on a surface thereof facing the tube, an inclined plane and two flat ends, and the two flat ends of the pressing part are roughly substantially parallel to the first central axis with a first flat end being smaller in area than another a second flat end, and the first flat end is disposed more radially outward than the second flat end with reference to the first central axis, wherein the first flat end has a first perimeter and the second flat end has a second perimeter, and the inclined plane is parallel to the surface extending between the first perimeter of the first flat end and the second perimeter of the second flat end.

2. The tube pump according to claim 1, wherein the pressing part is in the form of a roller rotatable on a second central axis intersecting the first central axis.

3. The tube pump according to claim 2, wherein the pressing part rotates on the second central axis which is driven by its rotation around the first central axis.

4. The tube pump according to claim 2, wherein the pressing part is roughly in the shape of a truncated cone, the truncated cone comprises a bottom surface roughly orthogonal to the second central axis, an upper surface roughly orthogonal to the second central axis, having a smaller area than the bottom surface and disposed more outward than the bottom surface in the radial direction with reference to the first central axis, and a peripheral surface extending between the bottom surface and the upper surface, wherein the peripheral surface is the surface of the pressing part facing the tube, and the upper surface is the first flat end and the bottom surface is the second flat end.

5. The tube pump according to claim 1, wherein the holder part has a tube space accommodating the tube, the tube space is defined by a first wall surface facing the pressing part, and a second wall surface erected from the first wall surface and abutting against the bent portion of the tube from the radial outside with reference to the first central axis.

6. The tube pump according to claim 5, wherein, when a height of the second wall surface from a deepest part of the tube space in the direction of the first central axis is set to h, and a radius of a cross section of the tube is set to r, $h \geq r$.

7. The tube pump according to claim 5, wherein the first wall surface has an inclined part substantially parallel to the inclined plane of the pressing part.

8. The tube pump according to claim 7, wherein the first wall surface further has a horizontal part continuous with the inclined part, roughly orthogonal to the first central axis, and disposed more outward than the inclined part in the radial direction with reference to the first central axis, and the second wall surface is erected from the horizontal part.

9. The tube pump according to claim 5, wherein the tube space is further defined by a third wall surface erected from the first wall surface, facing the second wall surface, and disposed more inward than the second wall surface in the radial direction with reference to the first central axis, wherein one of the third wall surface and the second wall surface comprises a claw part protruding from a height position spaced a predetermined distance from the first wall surface toward the other of the third wall surface and the second wall surface to prevent the tube from falling out from the tube space.

10. The tube pump according to claim 1, further comprising a main body case accommodating the motor and the pressing part, wherein the holder part and the main body case are configured separable from each other.

11. The tube pump according to claim 10, wherein one of the holder part and the main body case has an engaging part, the other of the holder part and the main body case has an engaged part engaged with an engaging part, and the holder part is configured to be positioned with respect to the main body case when the engaging part and the engaged part are engaged with each other.

12. The tube pump according to claim 10, wherein one of the holder part and the main body case has a magnet on a surface facing the other of the holder part and the main body case, and the other of the holder part and the main body case has a magnetic body or a magnet which is facing and magnetically attracted by the magnet on the surface facing the other of the holder part and the main body case.

13. The tube pump according to claim 1, further comprising a spring urging the pressing part toward the holder part.

* * * * *